US006889834B2

(12) United States Patent
Ho

(10) Patent No.: US 6,889,834 B2
(45) Date of Patent: May 10, 2005

(54) TOOL BAG WITH MULTIPLE COMBINATIONS OF POCKETS

(76) Inventor: Cheng-I Ho, PO Box 82-144, Taipei (TW)

( * ) Notice: Subject to any disclaimer, the term of this patent is extended or adjusted under 35 U.S.C. 154(b) by 47 days.

(21) Appl. No.: 10/423,213

(22) Filed: Apr. 25, 2003

(65) Prior Publication Data

US 2004/0211690 A1 Oct. 28, 2004

(51) Int. Cl.[7] ..... B65D 85/28

(52) U.S. Cl. ..... 206/373; 224/583; 224/665; 224/684

(58) Field of Search ..... 206/349, 372–379; 224/575, 581–583, 665, 684

(56) References Cited

U.S. PATENT DOCUMENTS 4,369,526 A * 1/1983 Clutts ..... 2/51
5,361,412 A * 11/1994 Perry ..... 2/69
5,501,382 A * 3/1996 Webb ..... 224/673
5,971,101 A * 10/1999 Taggart ..... 182/129
6,065,658 A * 5/2000 Hashimoto ..... 224/647
6,398,092 B1 * 6/2002 Ansley ..... 224/582
6,662,373 B2 * 12/2003 Frank ..... 2/94

* cited by examiner

*Primary Examiner*—Jila M. Mohandesi
(74) *Attorney, Agent, or Firm*—Leong C. Lei

(57) ABSTRACT

A tool bag with multiple combinations is disclosed. The tool bag includes a plurality of tool pockets which can be replaced with each other and are mounted onto a waist strap. A plurality of gaps are formed on the back side of all the tool pockets such that a belt can pass through the gaps, allowing the tool bag structure to be mounted onto a user. The user can easily access to the tools.

2 Claims, 17 Drawing Sheets

TOOL BAG WITH MULTIPLE COMBINATIONS OF POCKETS

BACKGROUND OF THE INVENTION (a) Technical Field of the Invention

The present invention relates to tool bag structure. More particular, a tool bag with multiple combinations of pockets to hold different types of working tools, facilitating the accessible by the user.

(b) Description of the Prior Art

FIG. 1 shows a conventional tool bag described in Taiwan Patent publication no. 206 133. In application, the tool bag is mounted to the waist of the user. Two pockets are mounted to the waist strap which is tied to the waist. Rivets are used to fasten the pockets to the waist strap. The drawback of the conventional tool bag is that the pockets are fixed that cannot be detached for replacement or combination, and the storing of tools in these pockets is generally specific. Accordingly, different types of pockets have to be mounted for storing or carrying tools for various kinds of applications. If the specific pockets are not appropriate to the user to keep the tools, the designs of the pocket have to be changed and accordingly, it is a waste of material and in turn an increase in the production cost. Accordingly, it is an object of the present invention to provide a tool bag with multiple combinations of pockets, wherein the pockets for storing or keeping tools are not fixed but can be changed if required.

SUMMARY OF THE INVENTION

A main object of the present invention is to provide a tool bag with multiple combinations of pockets, wherein the tool bag is secured over the shoulder of the user with straps and various types of pockets for tools can be flexibly changed with respect to the type of tools that required for a project.

A further object of the present invention is to provide a tool bag with multiple combinations of pockets, wherein the tool pocket and the waist strap are mounted by employing a male and a female fastener.

Still another object of the present invention is to provide a tool bag with multiple combinations of pockets, wherein the pockets are downwardly hung which are easily accessible to the user and the tools within the tool pockets can be easily taken out.

Yet another object of the present invention is to provide a tool bag with multiple combinations of pockets, wherein the two lateral sides of the strap can be mounted with other types of tool pocket such that the tools can be suspended thereto.

Still another object of the present invention is to provide a tool bag with multiple combinations of pockets, wherein the tool pockets can be used to accommodate all types of tools and it is economical to produce the pockets.

The objects and other advantages of the present invention are best understood with reference to the preferred embodiment when read in conjunction with the following drawings, wherein:

DETAILED DESCRIPTION OF THE PREFERRED EMBODIMENTS

The tool bag structure according to the present invention is now described in detail.

Figure 1:
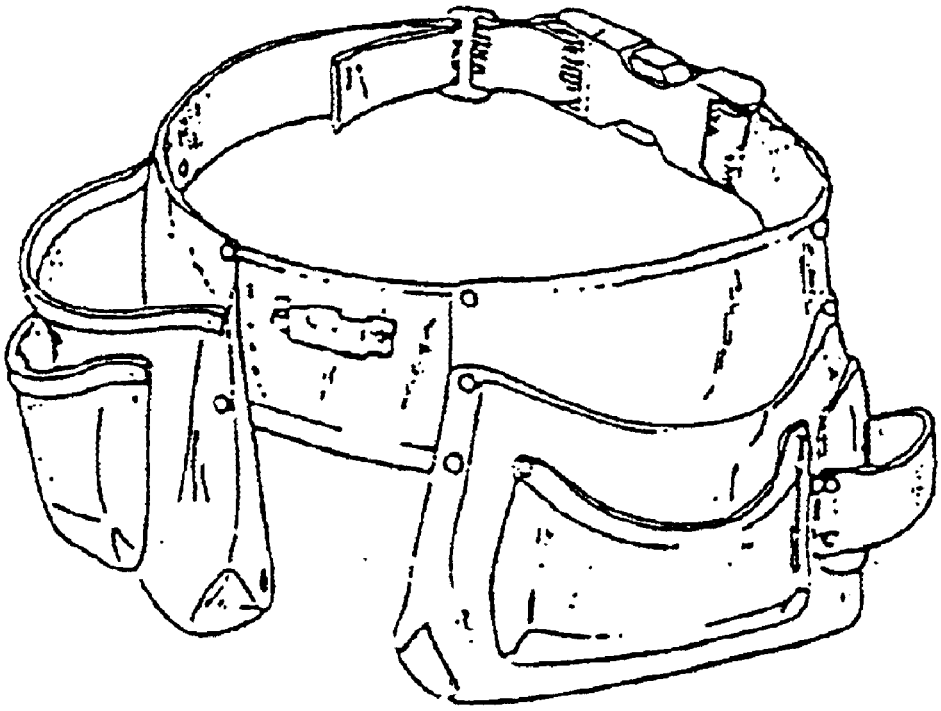
PRIOR ART FIG. 1
FIG. 1 is a perspective view of a conventional tool bag.
Figure 2:
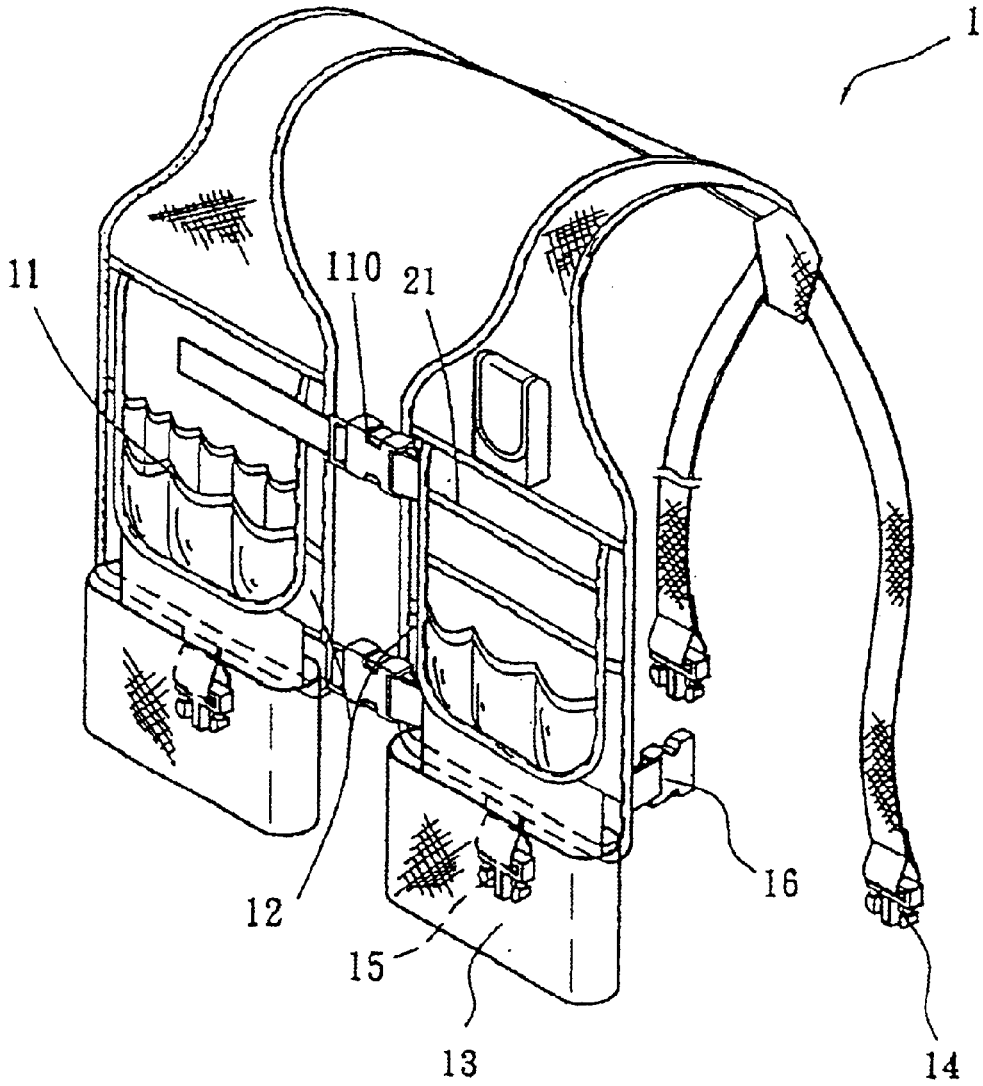
FIG. 2 is a perspective view of a vest-type tool bag of the present invention.

A Preferred embodiment of the present in vention is shown FIG. 2.

FIG. 2 is a perspective view of a vest-type tool bag structure 1 having a plurality of pockets 11 at the front thereof at both ends thereof. An insertion tool bag 11 is mounted to the vest-type tool bag. An insertion button 110 is disposed between the vest-type tool bag 1 and the insertion tool bag 1 provided with small size tool insertion pocket 12. The front face of the vest, is provided with a tool holding pocket 13 and the two straps are connected to form two branch straps mounted with a male fastener 14. Thus, the two sides of the tool bag pocket 1 are provided with a male and a female fasteners 15, 16 for replacement with other tool pockets.

Figure 3:
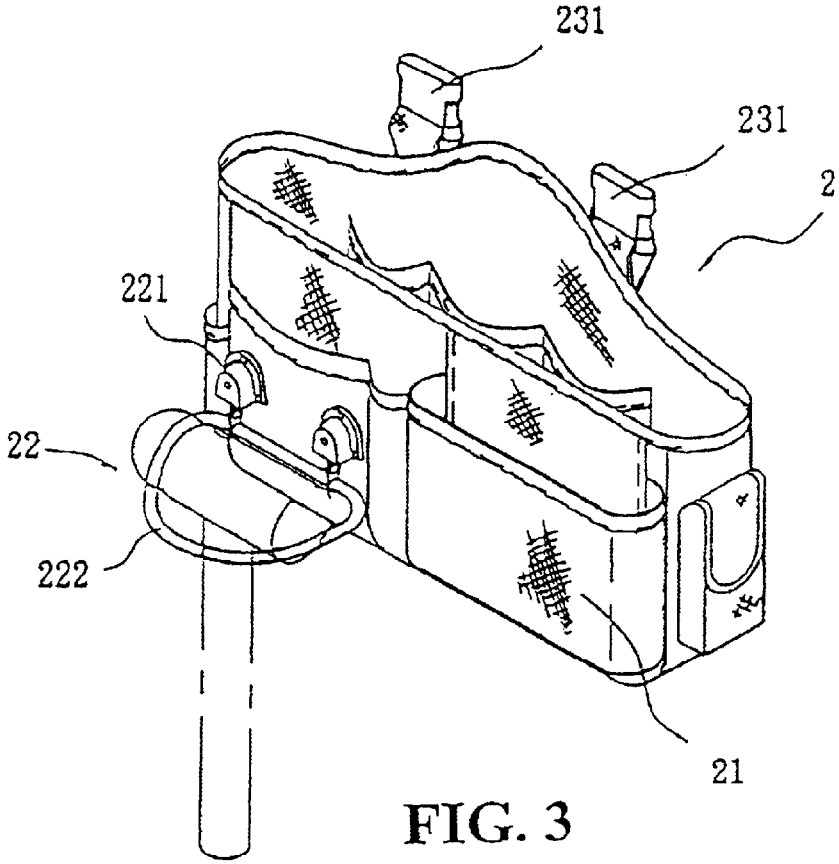
FIG. 3 is a perspective view showing the hammer-mounting side pocket of the present invention.
Figure 4:
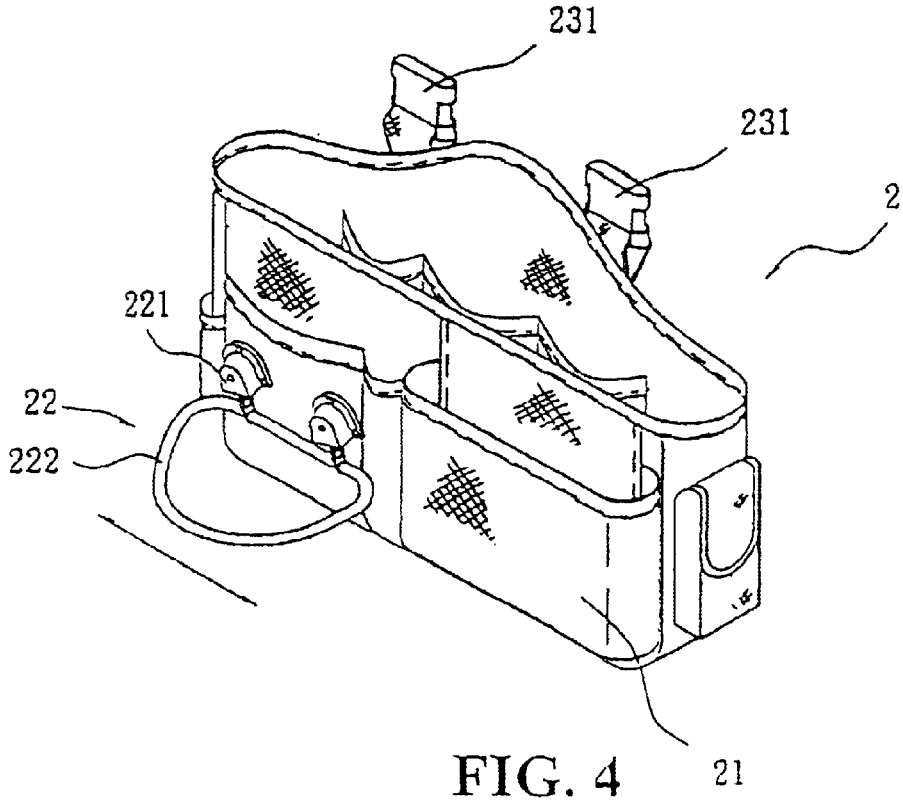
FIG. 4 schematically shows the range of movement of a hammer hook of the hammer of FIG. 3.
Figure 5:
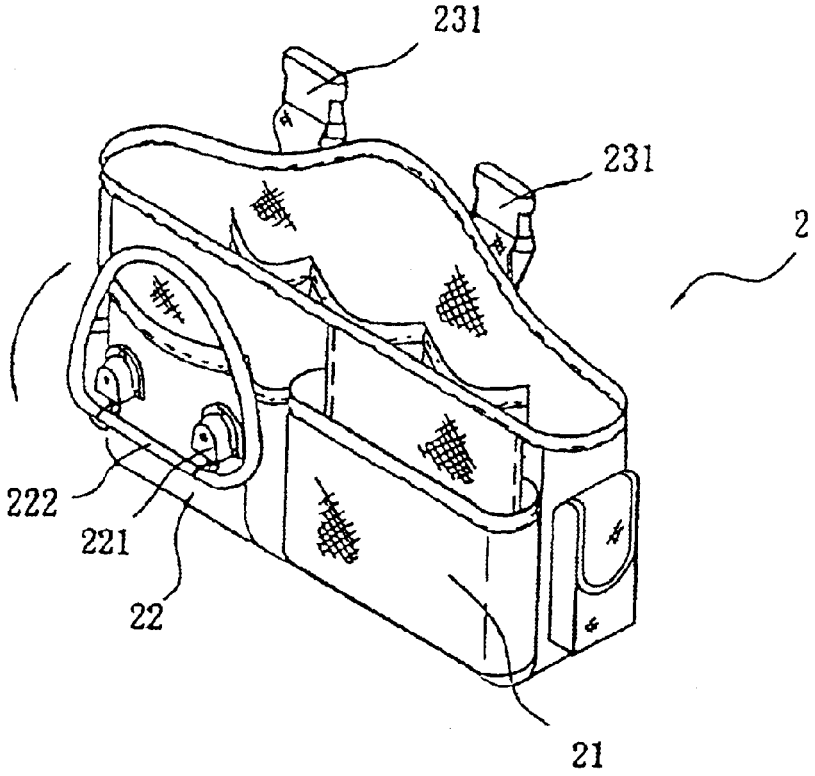
FIG. 5 is a perspective view showing the upward flip (to go degree) of the hook of FIG. 3.

Referring to FIG. 3, there is shown a hammer mounting side pocket 2 and the hammer mounting side pocket 2 has an arch-shaped opening. A plurality of tool insertion pockets 21 are provided to the front face of the pocket body and the left bottom side is a hammer suspension hook 22 mounted thereto the pocket body by rivets forming a connection button 221 and the bottom of the connection button 221 is extended to form a handle portion. The hook 222 is a L-shaped structure and a pivot is formed at the handle portion and the hook 222. The hammer as shown in FIGS.

4 and 5, is moveable within 90 degree. Two plate bodies 23 are provided at the rear face of the hammer mounting side pocket, and the top end of the pocket is a female insertion fastener 231 for engagement with another fastener. A hollow gap 24 is formed between the plate body and the pocket body.

Figure 6:
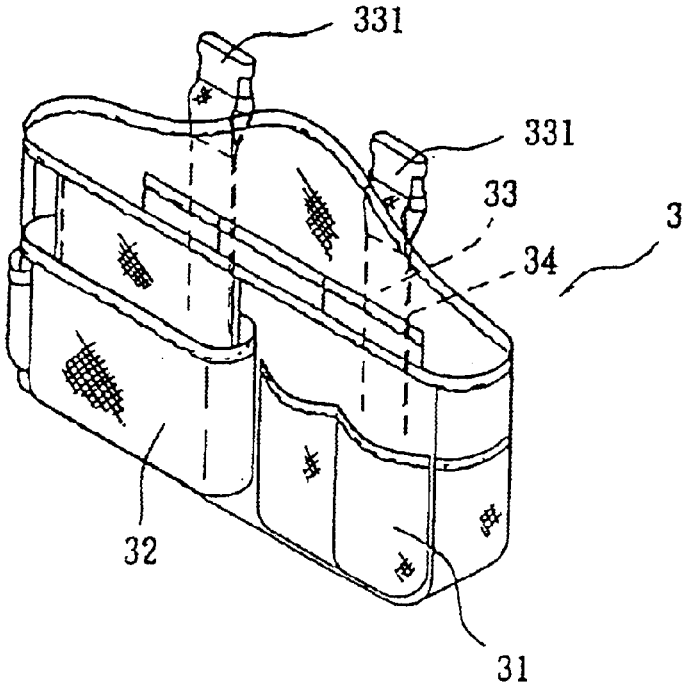
FIG. 6 is a perspective view of the tool-holding pocket of the present invention.

Referring to FIG. 6, there is shown the perspective view of a tool holding pocket 31 with an arch-shaped opening. A plurality of pockets 31 are formed into a small size tool holding pocket 31. Two plate bodies 33 are formed at the rear face of the pocket body and the two top ends are a female fastener 331 for engagement with another fastener. A gap 34 is formed between the plate body 33 and the pocket body.

Figure 7:
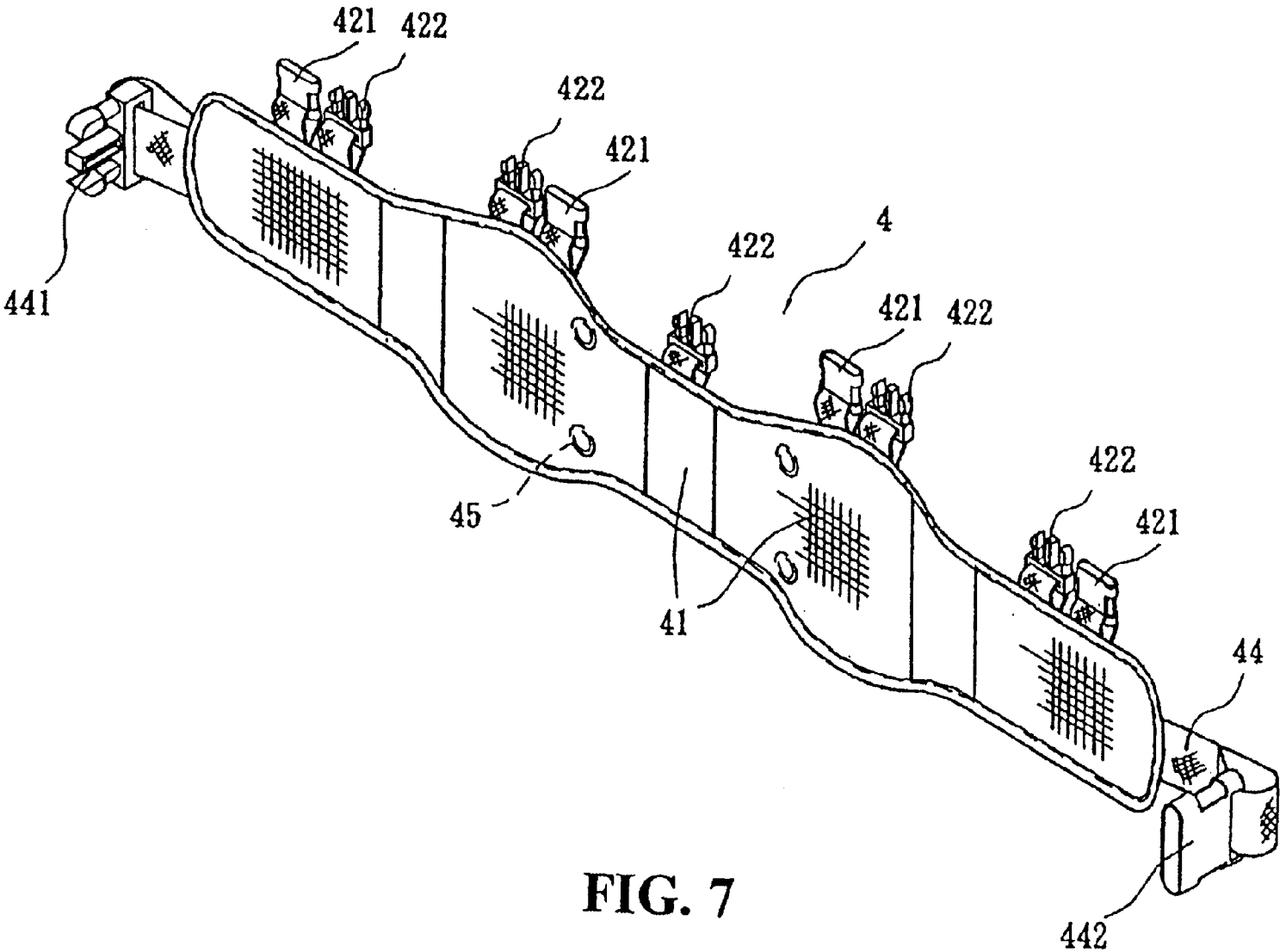
FIG. 7 is a perspective view of the waist strap of the present invention.
Figure 8:
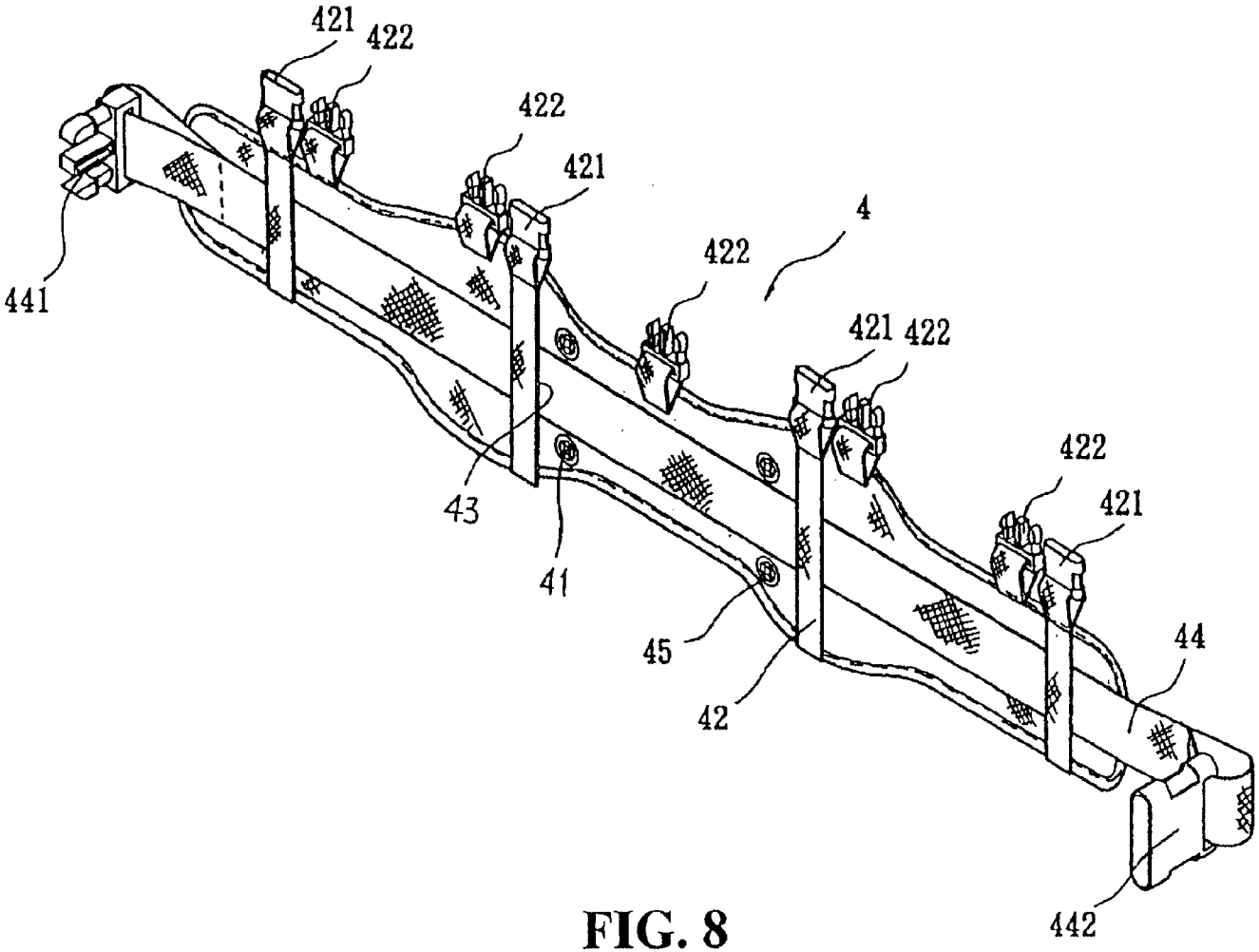
FIG. 8 is a perspective view of FIG. 7 from the rear position.

Referring to FIGS. 7 and 8, there is shown a waist strap 4 being a wide structure and curve at the edge thereof. The flat surface at the front side is provided with a sliding-stop pad 41, a plurality of plate bodies 42 are provided to the rear side of the strap 4 and the top end of the plate body 42 is a female fastener 421, wherein the middle section of the strap 4 is provided other than a female fastener 421, the two sides of the female fastener 42 are a male fastener 422. A gap 43 is formed between the plate bodies 42 and the strap 4, the gap 43 allows a belt 44 to pass through and is then fastened after the belt 44 surrounds the body of the user by employing the male and female fastener 441, 442, and the waist strap 4 is provided with a plurality of through holes 45.

Figure 9:
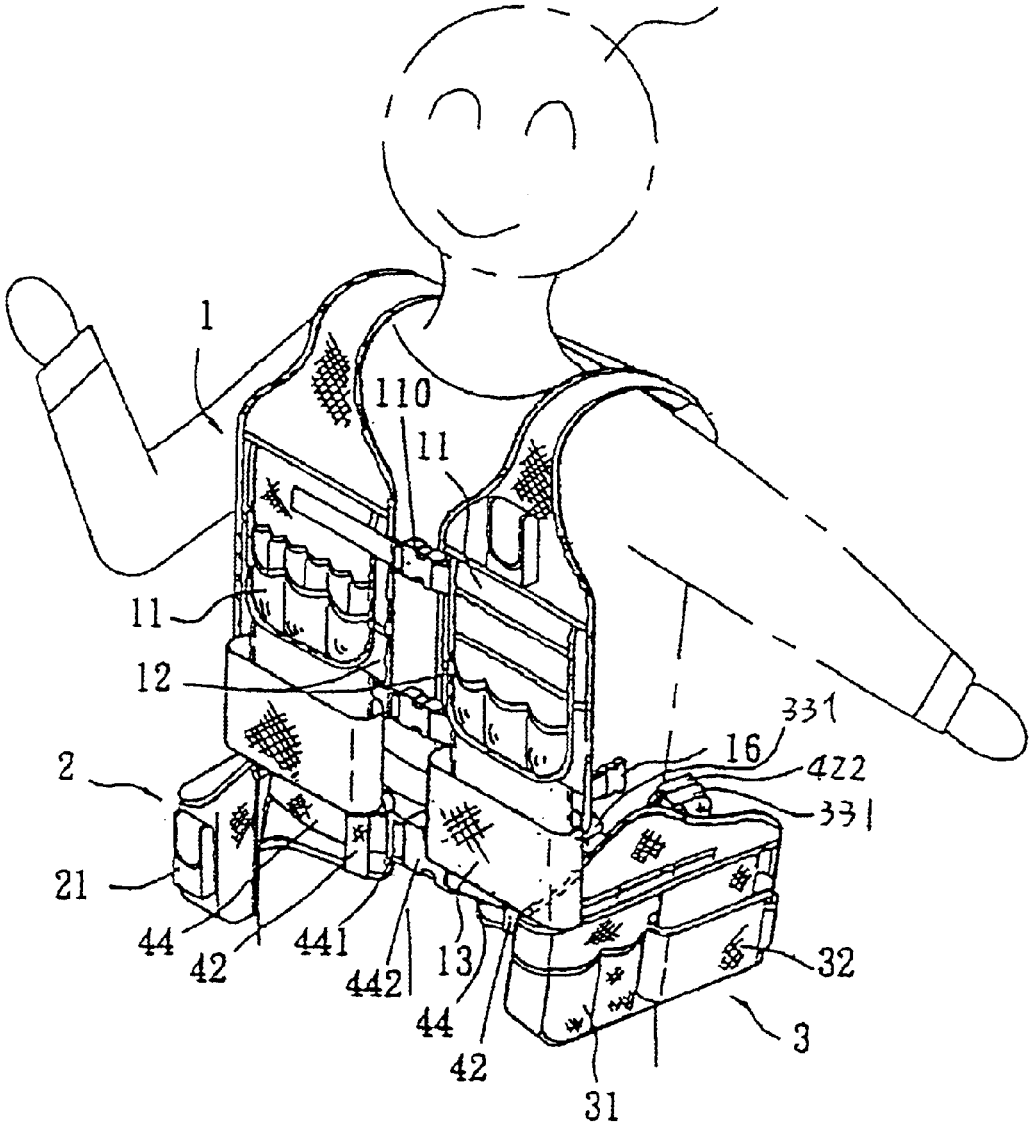
FIG. 9 is another preferred embodiment of the present invention.
Figure 10:
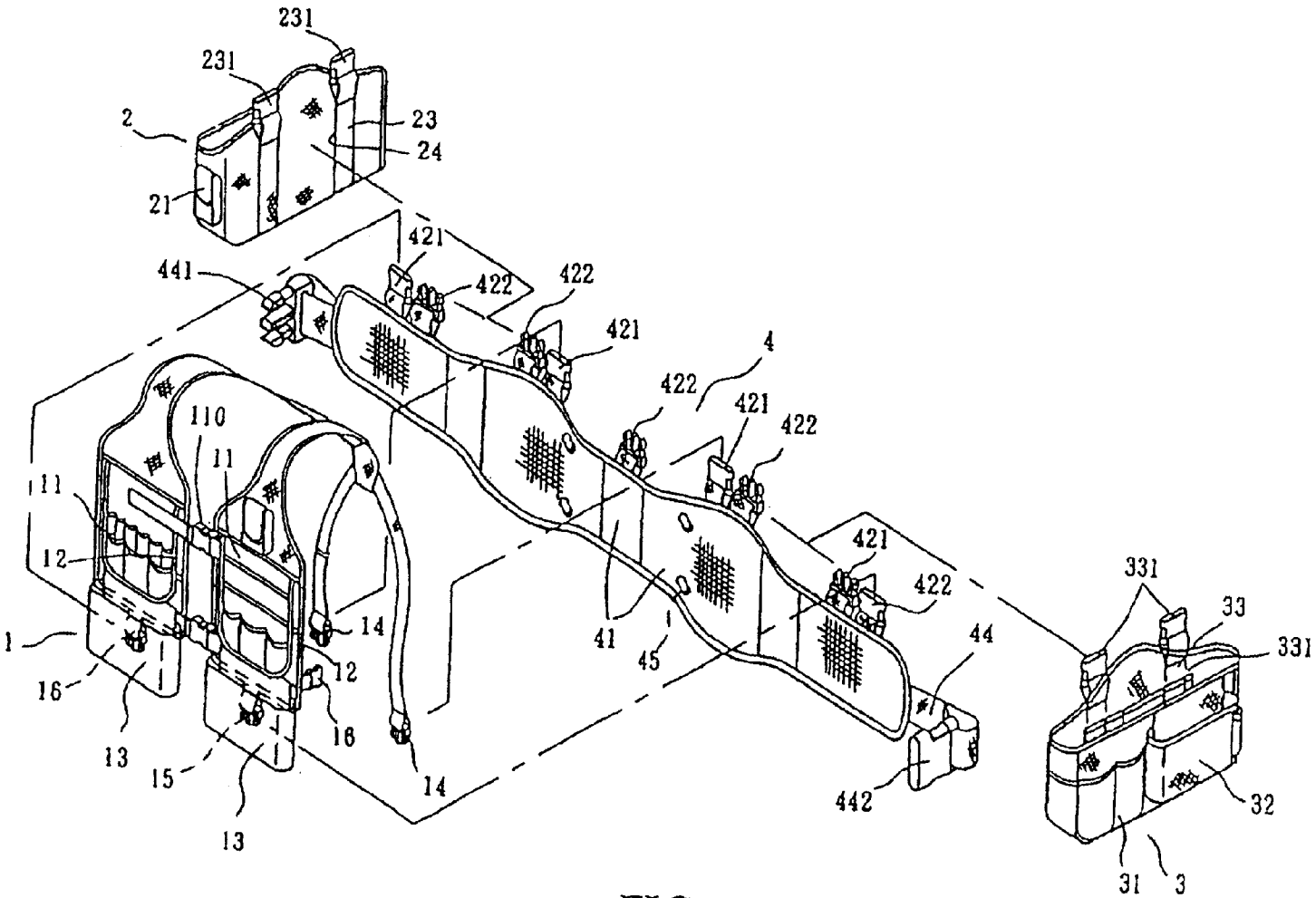
FIG. 10 is a perspective exploded view of FIG. 9 in accordance with the present invention.

Referring to FIGS. 9 and 10, there is shown an exploded perspective view of the present invention. The two female fasteners 331 are engaged with the two male fasteners 422.

The male fastener 15 at the lower edge of the tool bag 1 is engaged with the female fastener 421 of the waist strap 4. The male fastener 14 of the tool bag 1 is engaged with another female fastener 421 of the waist strap 4. Thus the tool bag 1 is connected to the waist strap 4 as a result of the male fasteners 15, 14 and the female fastener 421.

Figure 11:
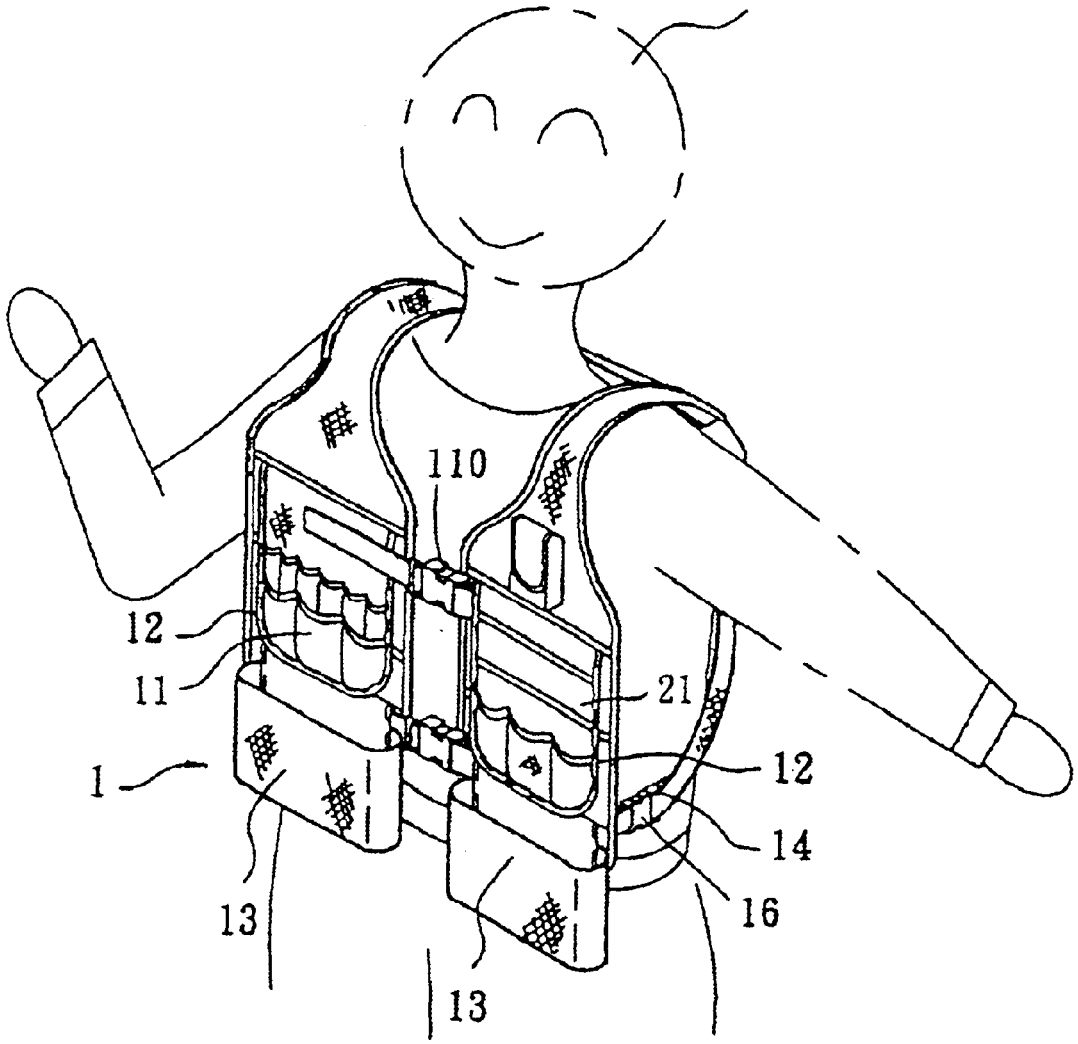
FIG. 11 is a preferred embodiment of the vest-type tool bag of the present invention.
Figure 12:
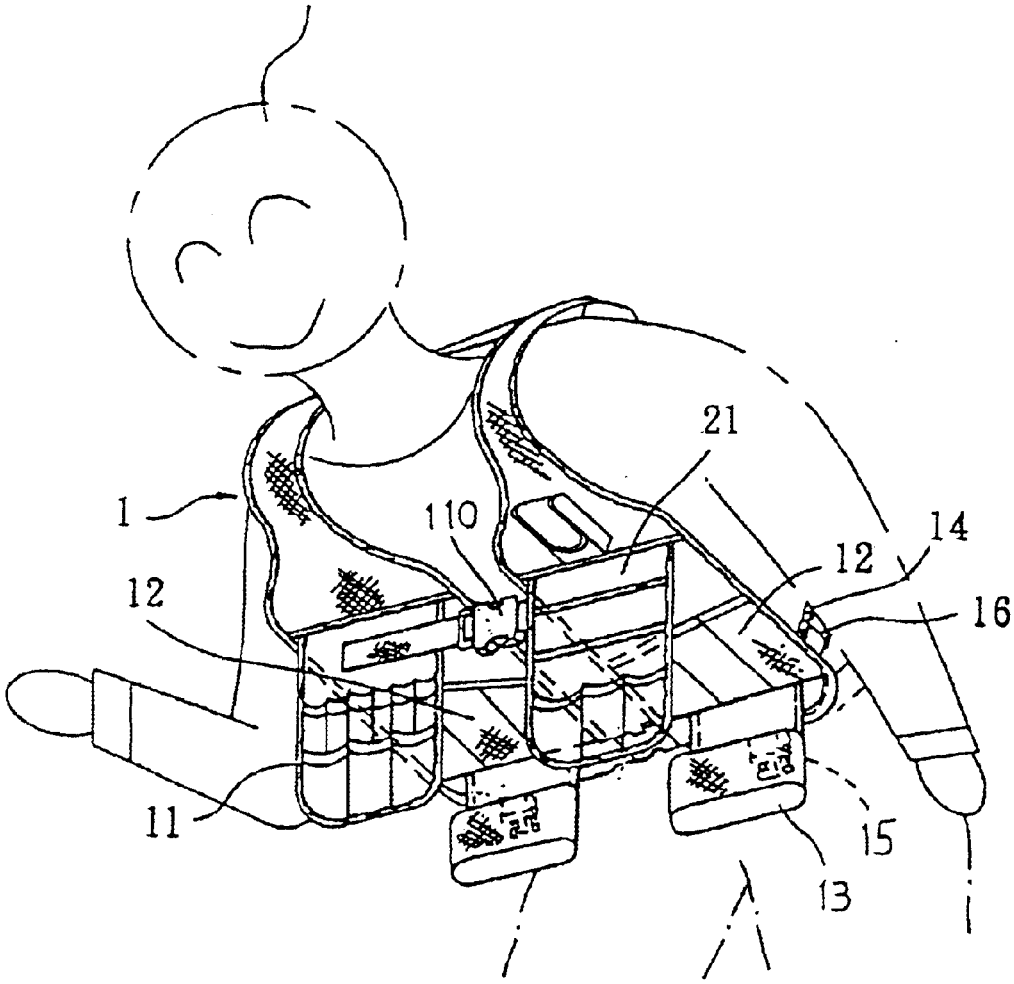
FIG. 12 is another preferred embodiment of FIG. 11 of the present invention.

Referring to FIG. 11, the vest-type tool bag 1 can be used alone, and the male fastener 14 at the end of the shoulder strap surrounds the shoulder and engaged with the female fastener 16. When the user bends forward, a supplementary tool pocket 11 of the tool bag 1 and the tool holding pocket 13 hang downward, facilitating the user to access the tools, as shown in FIG. 12.

Figure 13:
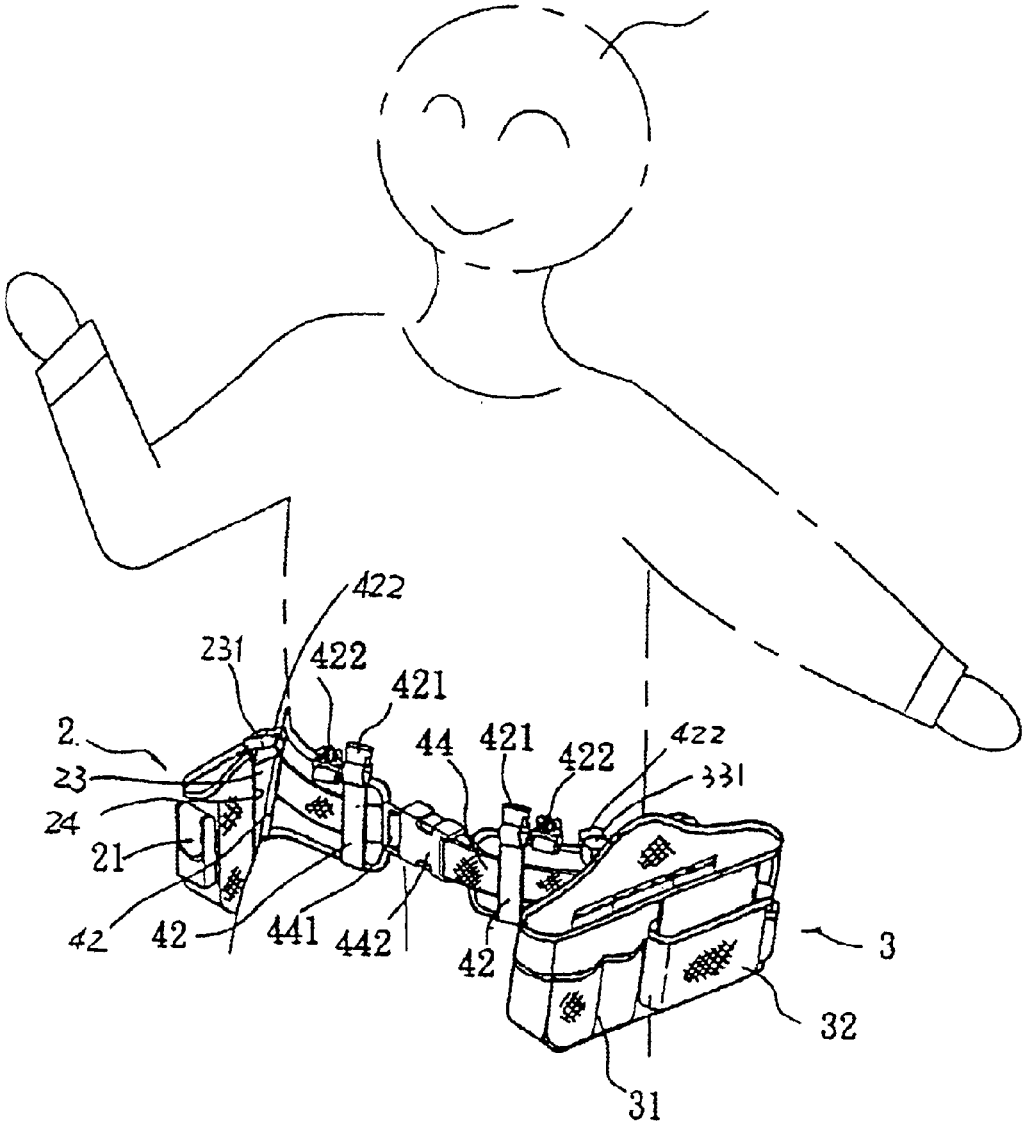
FIG. 13 is a perspective view showing the tool bag mounted at the waist strap of the present invention.

Referring to FIG. 13, there is shown a tool pocket positioned at the waist strap 4. The waist strap 4 is mounted to the waist of the user and secured by the male and female fasteners 441, 442. There are sliding-stop pads 41 on the inner face of the waist strap 4 to prevent the waist strap from falling. The two sides of the male fastener 422 of the plate body 42 are provided with a hammer mounting side pocket 2 and a tool holding pocket 3. The male fastener 422 of the waist strap 4 can be engaged with the female fastener 231 of the hammer mounting side pocket 2. The male fastener 422 is engageable with the female fastener 331 of the tool holding pocket 331 and the two sides of the waist strap 4 can be replaced by pockets which are required by the user in carrying out his project. For instance, tool pockets such as measuring-tape mounting pocket 5, elongated tool pocket 7, pliers holding pocket 8, drill holding pocket 9, etc.

Figure 14:
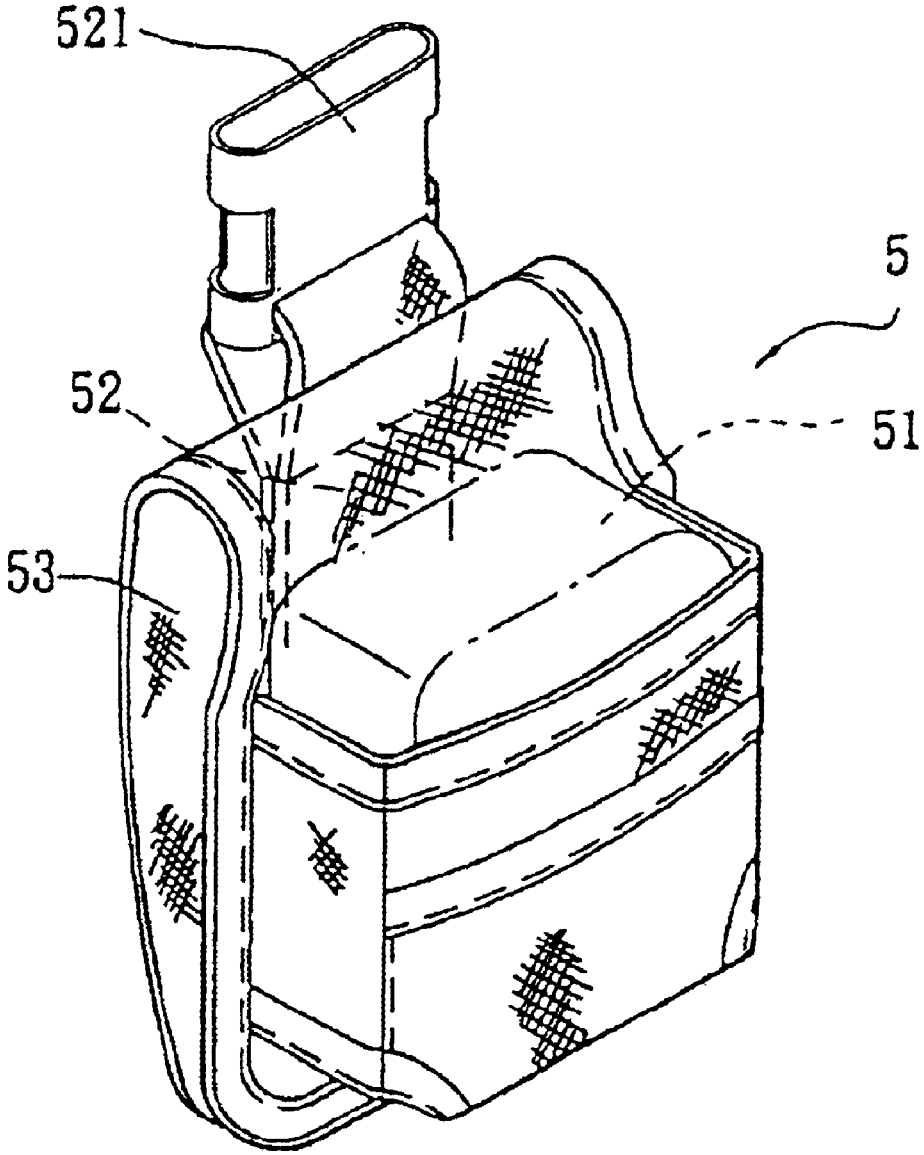
FIG. 14 is a perspective view of the measuring tape-mounting pocket of the present invention.

Referring to FIG. 14, there is shown a perspective view of a measuring tape holding pocket 5 having a hollow slot for the storage of a measuring tape 5. A fabric surface is extended to the back of the rear face of the holding pocket 5 and a hollow gap 53 is formed between the pocket body and the bending region of the fabric surface allowing a belt 6 to pass through.

Figure 15B:
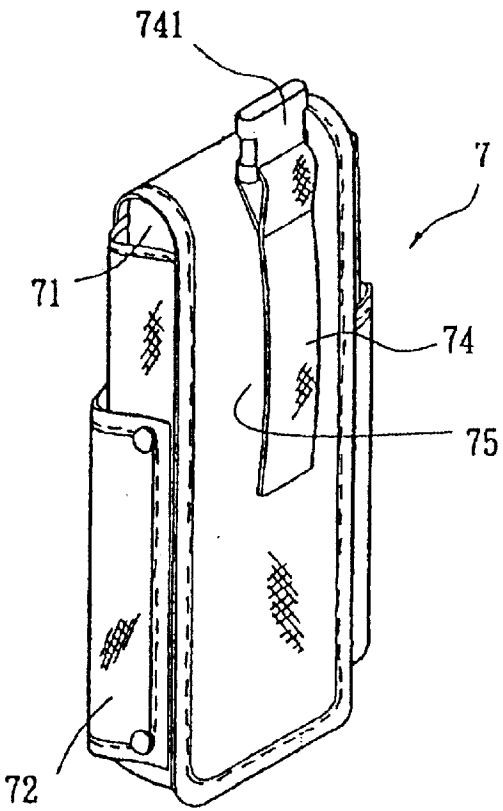
FIGS. 15A and 15B are different perspective views of the elongated tool bag viewed from the front and rear in accordance with the present invention.
Figure 15A:
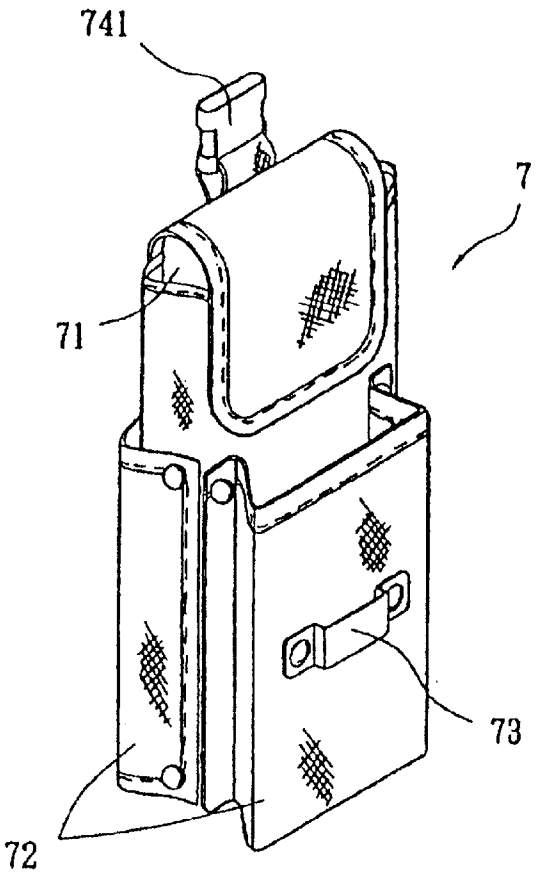

Referring to FIGS. 15A and 15B, there is shown a perspective view of an elongated tool pocket 7 having a tool holding slot 71 mounted with VELCRO, and the external edge of the main body of the pocket 7 is provided with a plurality of tool pockets 72 and one of the tool pockets 72 is provided with a measuring tape hook 73, and a plate body 74 is disposed onto the rear surface of the tool pocket 7, and a gap 75 is formed between the plate body 74 and the pocket body, allowing the belt 6 to pass through.

Figure 16B:
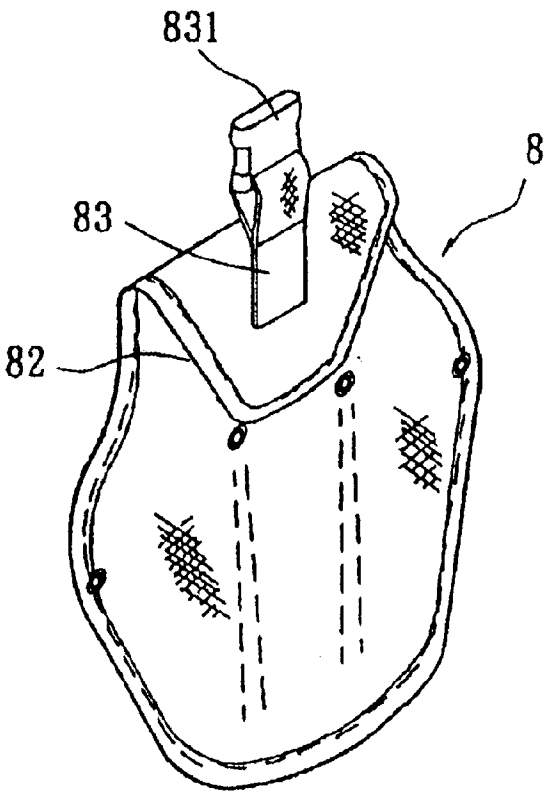
FIGS. 16A and 16B are different perspective views of the pliers mounting pocket viewed from the front and rear in accordance with the present invention.
Figure 16A:
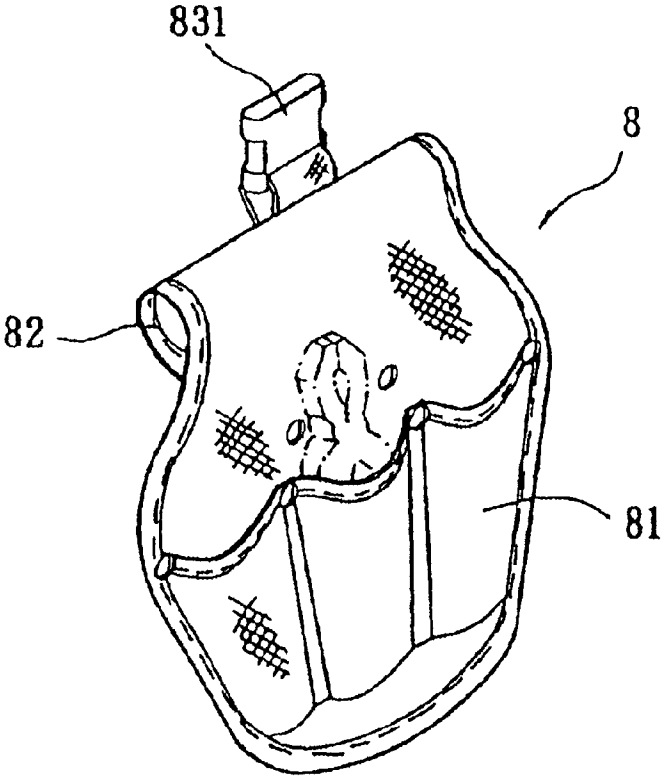

Referring to FIGS. 16A and 16B, there is shown pliers holding pocket 8 being a curvature plate body having a plurality of pliers-insertion pockets 81. A fabric face is extended to the rear section of the pocket body which is mounted using a plurality of rivets so that a gap 82 is formed between the bending region of the fabric face and the pocket 8 to provide a belt 6 to pass through. The rear face of the pocket 8 is a plate body 83 mounted onto the pocket body and the end portion of the rear face is a female fastener 831.

Figure 17B:
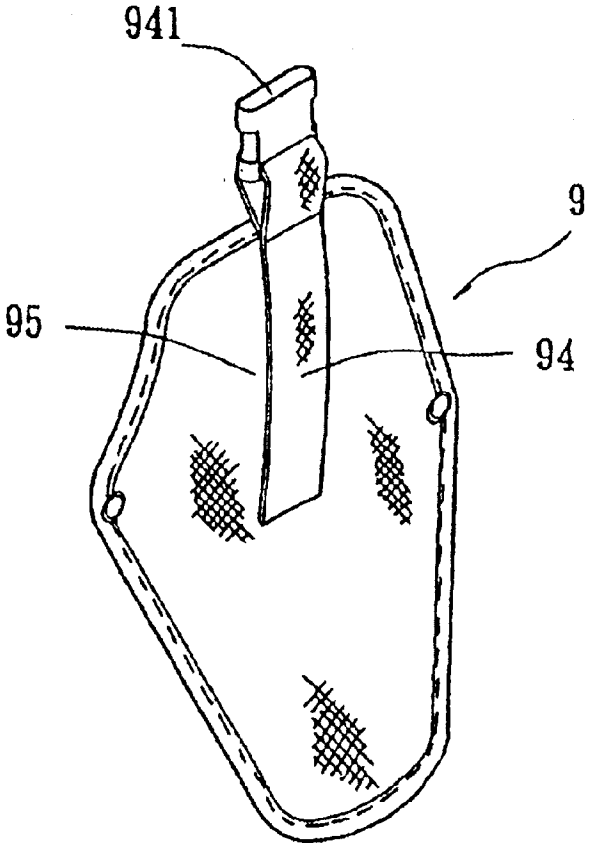
FIGS. 17A and 17B are different perspective views of the drill pocket viewed from the front and rear in accordance with the present invention.
Figure 17A:
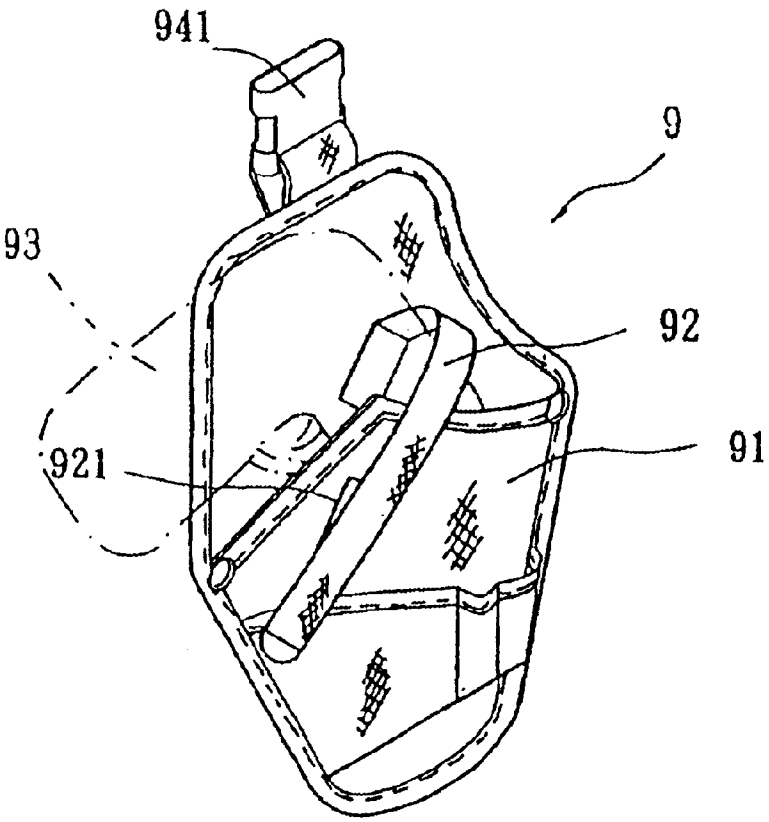

Referring to FIGS. 17A and 17B, there is shown a drill holding pocket 9 being a curvature plate having a plurality of tool holding pockets 91, and a securing strap 92 being mounted onto the pocket body and a VELCRO 921 is provided to the corresponding inner end portion of the pocket body. The rear face of the pocket 9 is a plate body 94 mounted onto the pocket body and a female fastener 941 is mounted at the end portion of the plate body, wherein a gap 95 is formed between the plate body and the pocket body 9, allowing a belt 6 to pass through.

Figure 18:
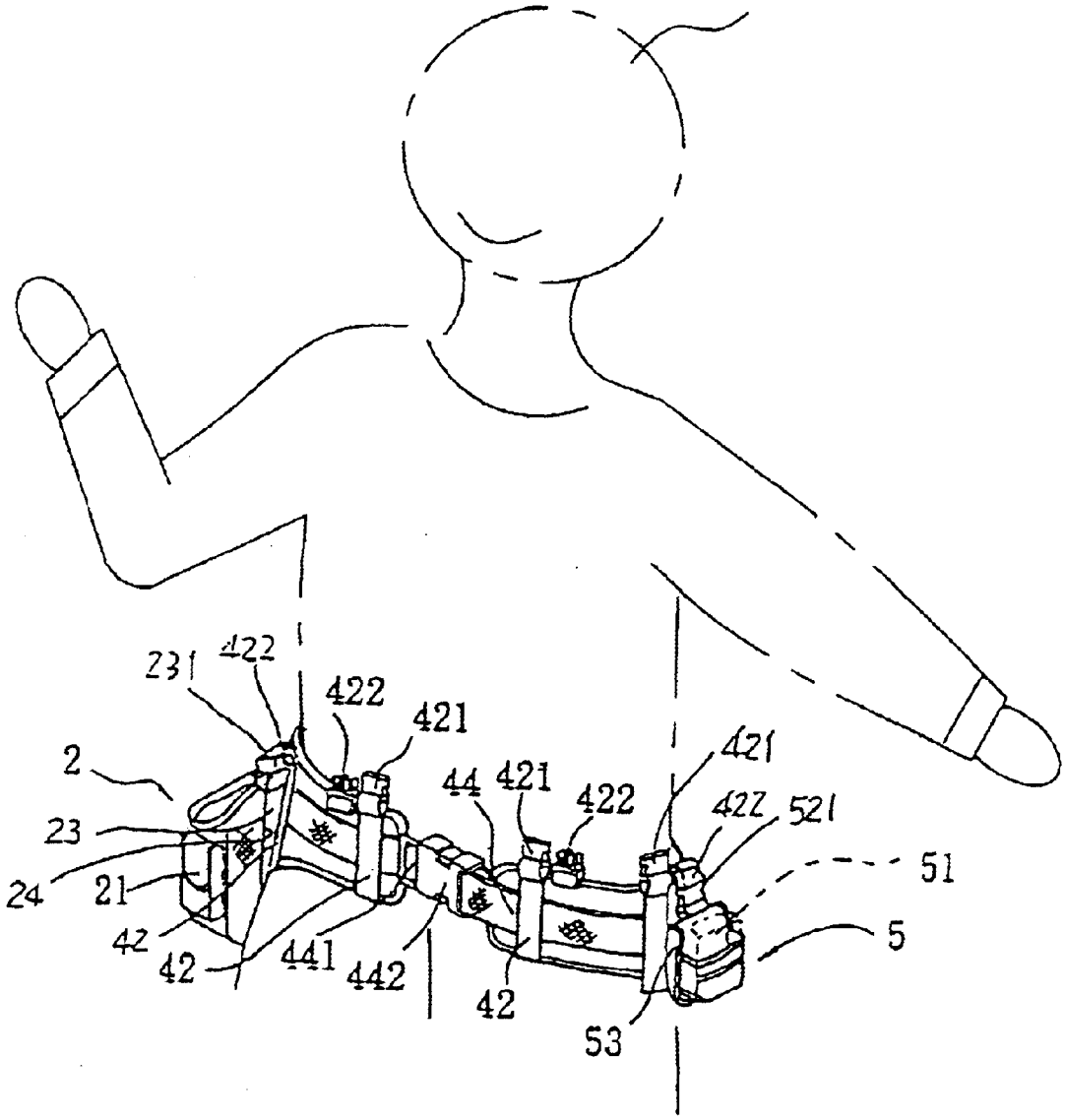
FIG. 18 is a schematic view showing the tool bag mounted to the waist in accordance with the present invention.
Figure 19:
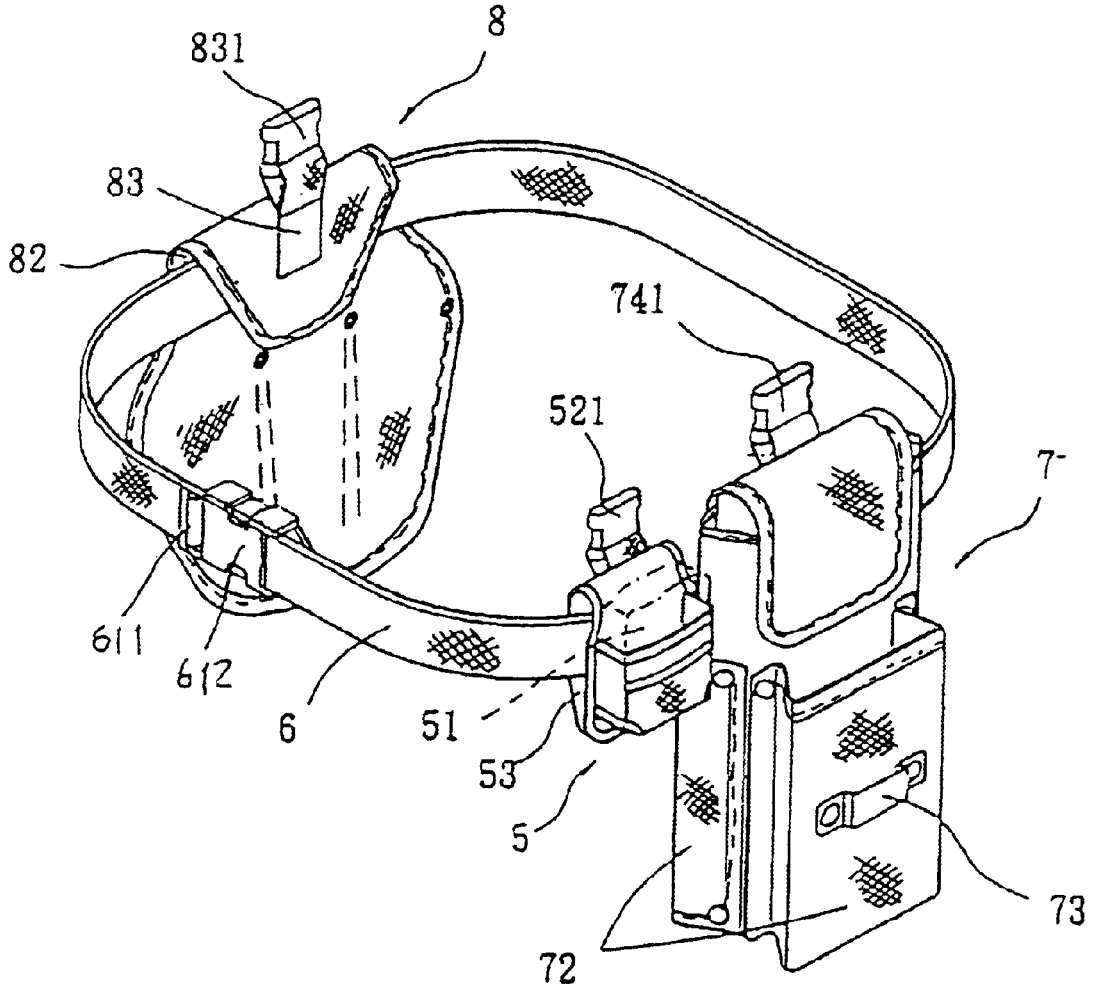
FIG. 19 is a perspective view showing a belt passing through the gaps of the tool bag in accordance with the present invention.

Referring to FIG. 19, there is shown a belt passed through the gaps in accordance with the present invention. In view of the above, there are gaps 24, 34, 53, 75, 82, 95 on the back of the hammer mounting side pockets 2, tool holding pocket 3, measuring tape holding pocket 5, elongated tool pocket 7, pliers holding pocket 8, drill holding pocket 9. The gaps allow the belt 6 to pass through for fastening to the user. FIG. 18 is a schematic view showing the tool bag mounted to the waist in accordance with the present invention. While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A tool bag structure with multiple combinations of pockets comprising:

(a) a vest-type tool bag having a plurality of pockets at the front at both ends thereof and an insertion tool bag being mounted to the vest-type tool bag, an insertion button disposed between the vest-type tool bag and the insertion tool bag provided with small size tool insertion pocket, the front face of the vest being provided with a tool holding pocket, two straps being connected to form two branch straps mounted with a male fastener, thereby the two sides of the tool bag pocket are provided with a male and a female fasteners for replacement with other tool pockets;

(b) a hammer mounting side pocket with an arch-shaped opening and provided with a plurality of tool insertion pockets, the left bottom side being a hammer suspension hook mounted thereto the pocket body by rivets forming a connection button and the bottom of the connection button extended to form a handle portion, the hook being an L-shaped structure and a pivot being formed at the handle portion and the hook, the hammer being moveable within 90 degree, two plate bodies provided at the rear face of the hammer securing side pocket, and the top end of the pocket being male insertion fastener for engagement with another fastener, hollow gap being formed between the plate body and the pocket body;

(c) a tool holding pocket with an arch-shaped opening, and provided with a plurality of pockets forming into a small size tool holding pocket, two plate bodies being formed at the rear face of the pocket body and the two top ends being a female fastener for engagement with another fastener, a gap being formed between the plate body and the pocket body; and (d) a waist strap being a wide structure and curve at the edge thereof, and a flat surface at the front side provided with sliding-stop pad, a plurality of plate bodies provided to the rear side of the strap and the top end of the plate body being female fastener, wherein the middle section of the strap is provided with a female fastener, and the two sides of the female fastener is a male fastener, a gap being formed between the plate bodies and the strap, the gap allows a belt to pass through and is then fastened after the belt surrounds the body of the user by emplying the male and female fastener, and the waist strap is provided with a plurality of through holes.

2. The tool bag structure of claim 1, further comprising a measuring tape holding pocket having a hollow slot for the storage of a measuring tape, and a fabric surface extended to the back of the rear face of the holding pocket, a hollow gap being formed between the pocket body and a bending region of the fabric surface allowing a belt to pass through.

* * * * *